US010595592B2

(12) United States Patent
Posato

(10) Patent No.: US 10,595,592 B2
(45) Date of Patent: Mar. 24, 2020

(54) CLOSURE BUCKLE FOR CLOSING A SKI BOOT

(71) Applicant: Rossignol Lange S.r.l., Montebelluna (IT)

(72) Inventor: Tiziano M Posato, Maser (IT)

(73) Assignee: Rossignol Lange S.r.l., Montebelluna (TV) (IT)

( * ) Notice: Subject to any disclaimer, the term of this patent is extended or adjusted under 35 U.S.C. 154(b) by 1 day.

(21) Appl. No.: 15/631,546

(22) Filed: Jun. 23, 2017

(65) Prior Publication Data

US 2017/0367443 A1 Dec. 28, 2017

(30) Foreign Application Priority Data

Jun. 27, 2016 (EP) ..... 16425064

(51) Int. Cl.
*A43C 11/14* (2006.01)
*A43B 5/04* (2006.01)

(52) U.S. Cl.
CPC ..... *A43C 11/1413* (2013.01); *A43B 5/04* (2013.01); *A43B 5/0417* (2013.01); *A43C 11/14* (2013.01); *A43C 11/142* (2013.01); *A43C 11/1406* (2013.01); *A43C 11/148* (2013.01); *A43C 11/1446* (2013.01); *A43B 5/048* (2013.01); *Y10T 24/2106* (2015.01); *Y10T 24/2183* (2015.01)

(58) Field of Classification Search
CPC ..... Y10T 24/2106; Y10T 24/2142; Y10T 24/216; Y10T 24/2183; A43C 11/14; A43C 11/1406; A43C 11/1413; A43C 11/142; A43C 11/1446; A43B 5/04; A43B 5/0417
See application file for complete search history.

(56) References Cited

U.S. PATENT DOCUMENTS 4,651,392 A * 3/1987 Olivieri ..... A43C 11/142 24/68 SK
5,509,180 A * 4/1996 Benetti ..... A43C 11/1406 24/68 SK
6,145,168 A * 11/2000 Baggio ..... A43C 11/1406 24/68 SK

FOREIGN PATENT DOCUMENTS

EP 0 657 117 A1 6/1995
FR 2 317 890 A1 2/1977

* cited by examiner

*Primary Examiner* — Robert Sandy
*Assistant Examiner* — Michael S Lee
(74) *Attorney, Agent, or Firm* — McCarter & English, LLP

(57) ABSTRACT

The invention relates to a closure buckle for closing a ski boot, which buckle comprises a main lever (2) hinged to a base (1) and having a longitudinal notch (20) in which a tie rod (3) is mounted that is connected to a fastener hook and that has an end carrying an auxiliary lever (4), said buckle being characterized in that the main lever (2) is provided with a protective plate (21) laterally defining a housing (24) for receiving the auxiliary lever (4), and the invention also relates to a downhill ski boot equipped with such buckles.

18 Claims, 3 Drawing Sheets

CLOSURE BUCKLE FOR CLOSING A SKI BOOT

The invention relates to an improvement in buckles for closing sports footwear, and more particularly for closing ski boots for downhill or "Alpine" skiing, cross-country skiing, or snowboarding.

More precisely, the invention relates to an improvement in buckles for closing a downhill ski boot designed, more particularly, for competitive skiing.

SUMMARY OF THE INVENTION

A downhill ski boot generally comprises a rigid outer shell formed of a collar facing the calf of the user and hinged to a lower shell portion encasing the bottom of the leg and the foot of the user, which shell is provided with a manual closure system having tightening buckles and fastener hooks.

Such a closure system is described, in particular, in EP 657 117, in which each buckle comprises a main lever or "tensioning lever" hinged to a base and having a longitudinal notch in which a tie rod is mounted that is connected to a fastener hook.

In the version designed mainly for downhill ski boots, and in particular for competitive skiing, the free end of the tensioning lever carries an auxiliary lever having its middle longitudinal axis offset towards the rear of the buckle relative to the axis of the tensioning lever to enable the buckle to be opened more easily. That configuration also has a bevel designed to prevent the risks of accidental snagging of the buckle, in particular during contact with slalom poles or indeed with ski sticks.

However, the auxiliary lever extends over the entire width of the tensioning lever while forming an intermediate space, and the part embodying its pivot axis is received in a duct that opens out directly onto the bevel, and that is therefore not protected.

Because of this space situated in the zone of connection between the two levers, there remains a risk of snagging with poles or sticks that can collide with the boot and the buckle in an upward movement, and there therefore still remains a risk of the buckle opening in untimely manner.

FR 2 317 890 describes a boot whose closure buckle is protected from impacts by a protective device for protecting the lever, which device is constituted by a projection forming a ramp-shaped lip that is formed towards the front of the shell, that is placed in front of the buckles, and that forms a shield for deflecting poles.

However, that version requires the mold for manufacturing the shell to be modified, and is not sufficiently effective.

In addition, since the auxiliary lever is designed to facilitate taking hold of the tensioning lever and opening the buckle, it is, by its very structure, all the more likely to be opened in untimely manner because it is the member of the closure system that requires the smallest forces to open it. It is therefore important to protect the auxiliary lever from any unwanted interaction with elements in the surrounding environment.

An object of the invention is to remedy those technical problems by modifying the structure of the buckle.

The invention achieves this object by providing a closure buckle for closing a ski boot, which buckle comprises a main lever hinged to a base and having a longitudinal notch in which a tie rod is mounted that is connected to a fastener hook and that has an end carrying an auxiliary lever, said buckle being characterized in that the main lever is provided with a protective plate laterally defining a housing for receiving the auxiliary lever.

According to an advantageous characteristic, the plate is offset at least partially towards the rear of the buckle.

According to another characteristic, the plate extends over the lateral side of the auxiliary lever.

In a first variant, the respective edges of the plate and of the auxiliary lever extend parallel to each other.

Preferably, the plate extends along an axis that is inclined at an angle lying in the range 0° to 90° relative to the longitudinal axis of the tie rod.

According to yet another characteristic, the auxiliary lever has a pivot axis that is not perpendicular to the axis of the tie rod.

According to another characteristic, the plate projects from and is connected to the main lever via a first outer edge parallel to the axis of the tie rod and that is extended towards its free end by a second outer edge parallel to the middle axis of the auxiliary lever.

According to yet another characteristic, the second outer edge is extended by a third outer edge defining a tapered end that, towards the front of the buckle, closes the housing receiving the auxiliary lever by joining up with its end edge.

According to a specific variant, the upper face of the plate carries a bevel.

In which case, the bevel extends continuously over the upper face of the plate, and the thickness of the plate is thinner going towards its outer lateral edge.

Preferably, the upper face of the beveled plate comes flush with the upper face of the auxiliary lever.

In another variant, the lower face of the auxiliary lever and the lower face of the end of said plate are beveled and extend in the same plane that is raised relative to the plane of the base with a view to making it easier to take hold of them manually.

In yet another variant, the part embodying the pivot axis of the auxiliary lever is united with the protective plate.

The invention also provides a ski boot equipped with buckles as defined above.

Preferably, the plate is positioned towards the front of the boot while the auxiliary lever is positioned towards the rear of the boot.

By means of the contribution made by the invention, it is no longer necessary to offset the axis of the tie rod in order to enable a bevel for protecting the buckle to be created.

In addition, the auxiliary lever is protected effectively by the front plate of the main lever that defines a housing that also accommodates the bearing for the part embodying the pivot axis.

Finally, when the boot is being used for competitive skiing, the risks of snagging on poles are removed due to the fact that the buckle has only one single and continuous beveled face over its entire front edge, without any roughness or interruption.

BRIEF DESCRIPTION OF THE FIGURES

Other characteristics and advantages of the invention appear on reading the following description, with reference to the accompanying figures, in which.

To make the drawings clearer, identical or similar elements are given identical references in all of the figures.

DETAILED DESCRIPTION OF EMBODIMENTS

Figure 1:
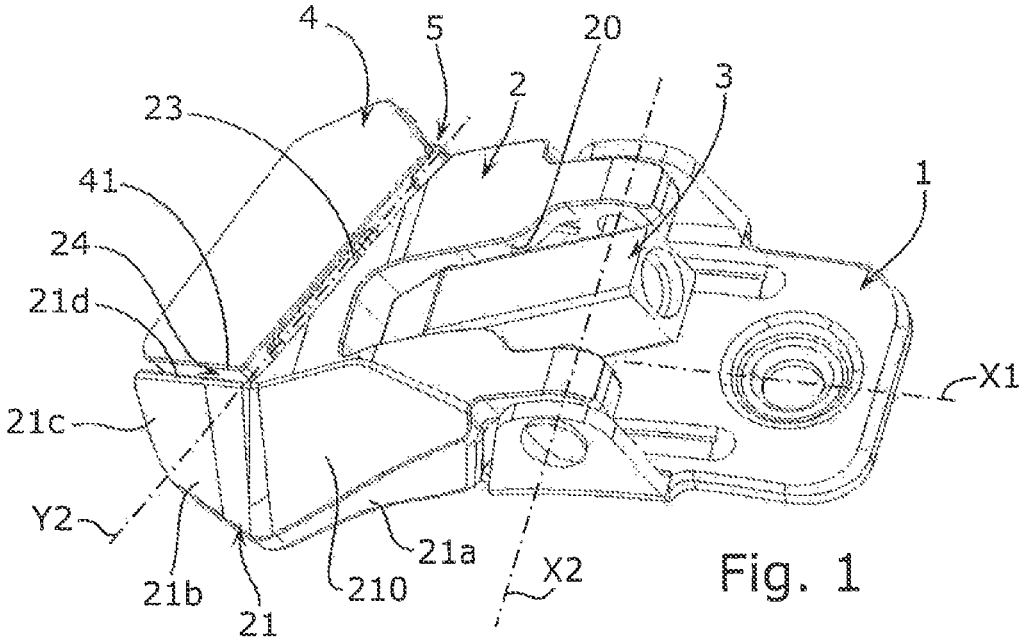
FIG. 1 is a perspective view of an embodiment of the buckle of the invention.
Figure 2:
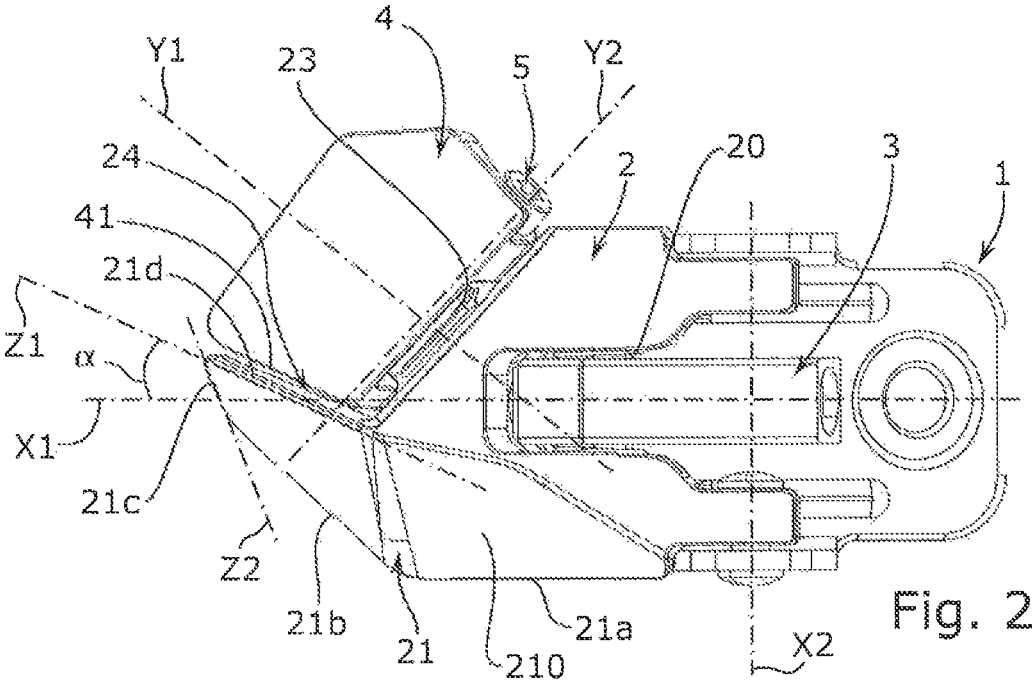
FIG. 2 is a view from above of the FIG. 1 buckle.
Figure 3:
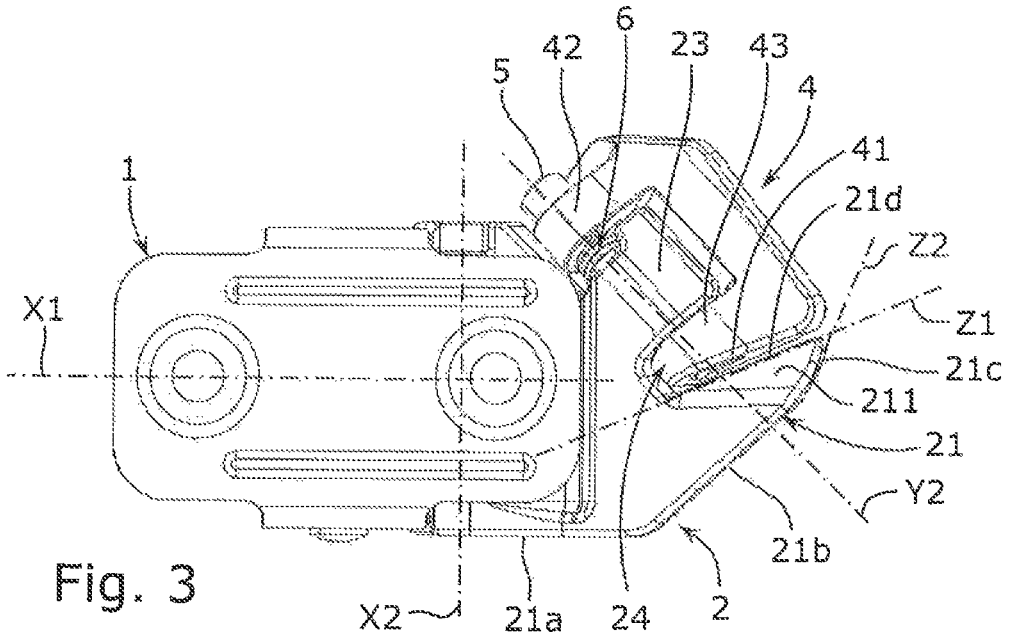
FIG. 3 is a view from below of the same buckle.

Naturally, the embodiment shown in the figures listed above and described below is given merely by way of non-limiting example. Within the ambit of the invention, provision is explicitly made for it to be possible to combine various embodiments so as to propose other embodiments. As shown in FIGS. 1 to 3, a ski boot buckle generally comprises a main lever or "tensioning lever" 2 hinged to a base 1, and having a longitudinal notch 20 in which a tie rod 3 is mounted that is connected to a fastener hook K (shown in FIG. 5).

In the following description, it is considered that the front of the buckle is on the side on which the tie rod 3 and the hook are situated.

Figure 5:
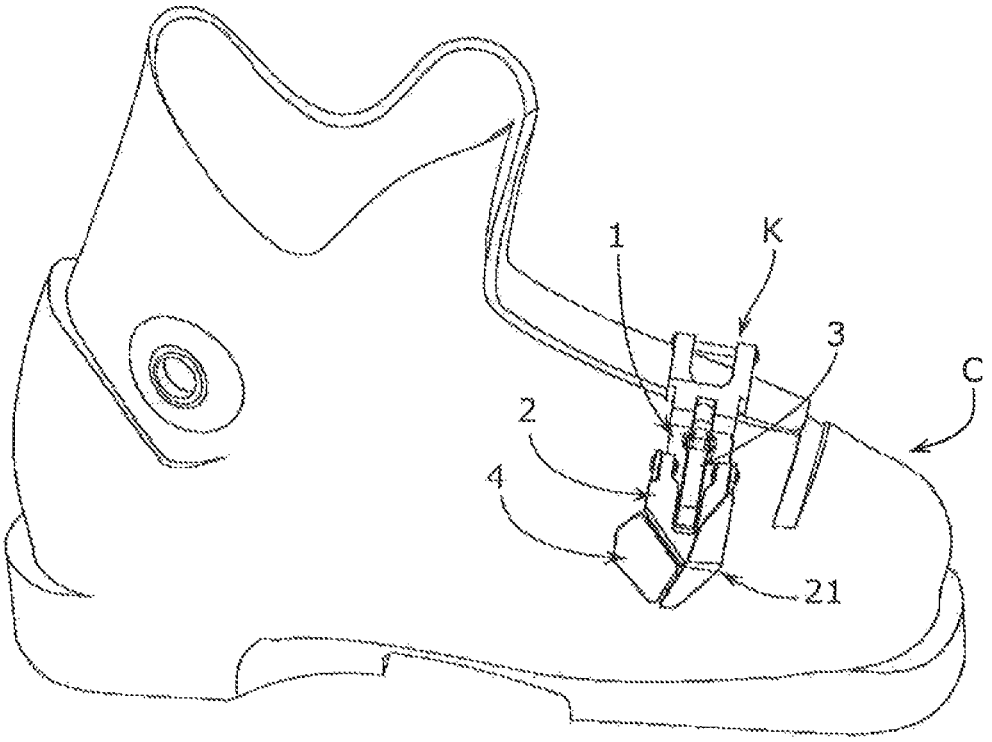
FIG. 5 is an overall view of a boot equipped with a buckle of the invention.

The base 1 is designed to be riveted to the upper face of the shell of the boot, and its longitudinal axis, which coincides with the axis X1 of the main lever 2 and of the tie rod 3, extends generally transversely over the shell of the boot, as shown in FIG. 5.

In a first embodiment shown in FIGS. 1 to 3, the free end of the tensioning lever, which end is the end that is further away from the fastener hook, carries an auxiliary lever 4 that has its middle longitudinal axis Y1 offset angularly relative to the longitudinal axis X1 of the main lever 2 that is itself perpendicular to the pivot axis X2 thereof. This offset is constituted by a shift towards the rear of the boot so that, in the event of a collision with an obstacle, a rearward departure angle or "escape angle" is provided. The middle longitudinal axis Y1 of the auxiliary lever 4 does not pass across the entire width of the main lever 2, but rather it is localized solely over a portion of the width of the main lever 2 that is situated towards the rear of the boot.

This configuration is motivated by the objective of avoiding the risks of the buckle snagging on slalom poles, in particular.

In such competitive skiing, skiers go past very close to the poles, and their boots often collide with them. This risk increases with increasing speed, since the body and the boots of the skier are then increasingly inclined, and it is the upper face of the boot, on which face the tightening buckles are situated, that is mainly exposed.

It has already been sought to reduce that risk with known buckles, but the configuration of the auxiliary lever and its position are not optimum, if only due to the presence, at the front of the buckle, of the projecting end of the part embodying the pivot axis Y2 of the auxiliary lever.

An object of the invention is to improve existing buckles by improving the protection of the auxiliary lever and by concomitantly reducing the risks of snagging.

The modifications that can be made, in accordance with the invention, to the components of the buckle, taken in isolation or in combination, are described in detail below.

In accordance with the invention, the main lever 2 comprises a lever body, and on the front side, i.e. on the side closer to the front of the boot, further comprises a plate 21 that projects from and extends the lever body, and that is positioned on one of the lateral sides of the auxiliary lever 4.

The plate 21 is connected to the body of the main lever 2 via a first outer edge 21*a* parallel to the axis X1 and followed continuously by a second outer edge 21*b* substantially parallel to the axis Z1. Preferably, the plate is an integral part of the main lever 2 and extends it to form a projection on the front of the main lever. In the embodiments shown, the plate 21 is formed integrally in one piece with the main tensioning lever 2, but said plate 21 could be an auxiliary part fastened to the end of the main lever 2, thereby making it possible, in particular to use a material different from the material of the main lever 2.

The intermediate edge 21*b* is extended by a third outer edge 21*c* forming a narrower end inclined along an axis Z2 and, towards the front of the buckle, closing the housing 24 of the auxiliary lever 4 by joining up with its end edge, as shown by FIGS. 2 and 3.

The plate 21 has a straight inner edge 21*d* closing the housing 24 facing the lateral edge 41 of the auxiliary lever 4. The edges 21*d* and 41 extend parallel to each other and are inclined along an axis Z1 at an angle .alpha. lying in the range 0.degree. to 90.degree. relative to the longitudinal axis X1 of the tie rod 3, as shown by FIG. 2. The plate 21 thus extends beyond the end of the main lever 2 while, towards the rear of the buckle, defining a housing 24 for receiving the auxiliary lever 4, which housing is closed towards the front and along the lateral side of the buckle by the edge 21*d*. The edges 21*b* and 21*c* of the plate 21 protect both the lateral edge 41 of the auxiliary lever 4 and also its pivot mechanism.

Inside this housing lie the pivot bearing 23 that is carried by the end of the body of the main lever 2 and that receives the pivot 5 of axis Y2, the ends of which pivot are engaged in rotary manner in respective ones of two ducts 42, 43 provided in the body of the auxiliary lever 4.

The pivot 5 is also coupled to a helical spring 6 disposed between the bearing 23 and one of the ducts 42, 43 (FIG. 3).

In a variant, one of the ends of the pivot 5 on the axis Y2 of the auxiliary lever 4 may be housed in the plate 21. Thus, the auxiliary lever may be hinged directly to said plate. Thus, in order to ensure that the auxiliary lever 4 is held better, the part embodying its pivot axis Y2 is united via the bearing 23 with the body of the main lever 2, and, concomitantly, in order to guarantee optimum mechanical guiding, the part embodying the pivot axis Y2 is also united with the plate 21.

In addition, the lower face 211 of the end segment defined by the tapered edge 21*c* of the plate 21 is beveled, as shown in FIG. 3. This configuration makes it possible to place the face 211 in the same plane as the plane of the lower face of the auxiliary lever 4 that is slightly raised relative to the plane of the base 1 with a view to facilitating manually taking hold of the auxiliary lever 4 and of the main lever 2. In addition, on its upper face 210, the plate 21 carries a bevel extending such that the thickness of the plate 21 decreases going away from the lateral edge 41 of the auxiliary lever 4. In other words, the outer edge of the plate 21 is thinner than the inner edge 21*d* of the plate 21. The bevel that is formed on the upper face 210 of the plate 21 extends continuously from the connection edge 21*a* to the end edge 21*c*.

Its inclination lies in the range 30° to 60° forwards relative to the upper face of the auxiliary lever in such a manner that in the event that a pole comes into contact with the buckle, the plate 21 can enable the pole to be guided and to escape outwards by making it easier for it to slide, without allowing it any possibility of snagging.

In order to improve the protection of the auxiliary lever 4 and further reduce the risks of snagging, the Invention makes provision to form the beveled upper face 210 of the plate in such a manner that it is flush with the auxiliary lever 4 and with the upper face of the main lever 2 at rest, as shown in FIG. 1.

The bevel forms a ramp or an inclined surface so that when a slalom pole collides with the buckle, it is guided and slides over the inclined surface, thereby being spaced apart from the buckle without any risk of snagging.

Figure 4:
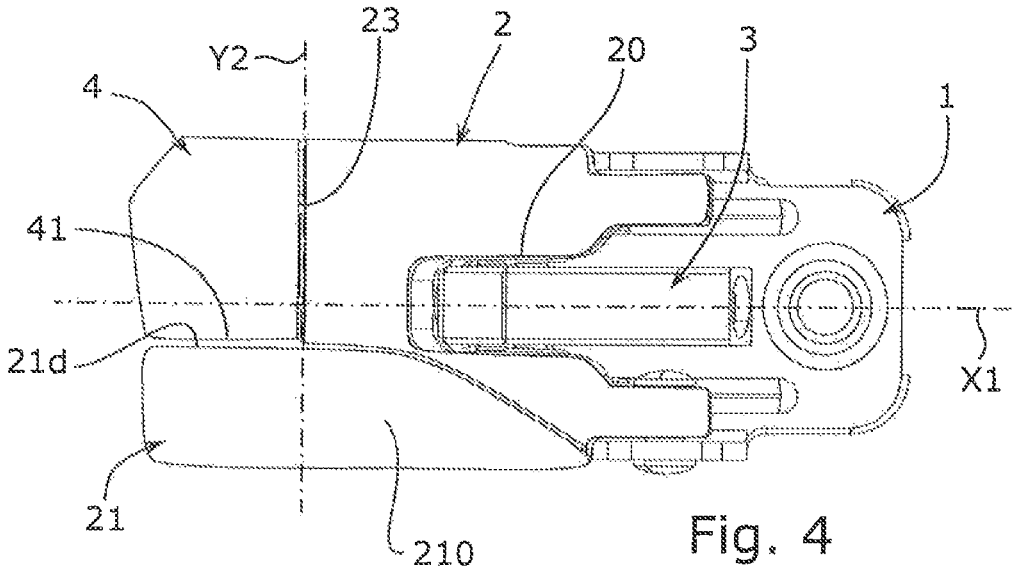
FIG. 4 is a view from above of a variant embodiment of the buckle of the invention.

Instead of a bevel, it is possible, in variants of the invention that are not shown, to give the upper face of the plate any other shape suitable for causing an object colliding with the buckle to be guided and to slide. For example, it is possible to provide a gradually decreasing thickness in the form of a rounded edge. In addition, the bevel of the tensioning lever may also extend onto the auxiliary lever. Thus, the end of the auxiliary lever is also partially beveled. Advantageously, the plate 21 has a beveled zone but it is not beyond the ambit of the invention for said plate 21 to be of constant thickness or even to have a projection of thickness greater than the thickness of the auxiliary lever 4. These various plate shapes 21 make it possible to achieve the object of the invention that is to protect the buckle from opening accidentally and in untimely manner. In the variant embodiment shown in FIG. 4, the auxiliary lever 4 is hinged about an axis Y2 perpendicular to the longitudinal axis X1 of the tie rod, the plate 21 on the main tensioning lever 2 coming to protect said auxiliary lever 4 laterally.

Preferably, the end zone situated at the front of the plate 21 has a rounded edge in order to avoid any untimely snagging with an external object.

The buckle of the invention is preferably made of metal, in particular of aluminum, but it could also be manufactured with plastics materials, optionally reinforced with fibers.

The buckle of the invention is designed to be used mainly on skiing or snowboarding footwear, and, in particular on a ski boot as shown in FIG. 5. In its lower portion, the shell C of this boot is provided, in this example, with a single set constituted by a buckle, as described above, associated with a fastener hook K that co-operates with a corresponding rack of teeth (not shown in FIG. 5) carried by the opposite side of the shell and locking and retaining the hook. Generally, the shell C is equipped with four sets of buckles, hooks and racks of teeth, respectively two at the collar of the boot, and two at the lower portion of the shell.

The invention claimed is:

1. A closure buckle for closing a ski boot, comprising:

a main lever hinged to a base, the main lever having a longitudinal notch in which a tie rod is mounted, the tie rod being connected to a fastener hook and the main lever having an end carrying an auxiliary lever, the auxiliary lever provided with a pivot mechanism, a lateral edge, and an end edge, wherein the main lever comprises a lever body and a protective plate, the protective plate having an outer edge extending beyond the end edge of the main lever and protecting the lateral edge and pivot mechanism of the auxiliary lever, said protective plate having an inner edge that is facing the lateral edge of the auxiliary lever.

2. The closure buckle according to claim 1, wherein said protective plate has a longitudinal axis offset at least partially towards a rear of the buckle relative to a longitudinal axis of the main lever.

3. The closure buckle according to claim 2, wherein said protective plate extends beyond the lateral edge of the auxiliary lever.

4. The closure buckle according to claim 1, wherein said protective plate extends beyond the lateral edge of the auxiliary lever.

5. The closure buckle according to claim 4, wherein the inner edge of said protective plate and the lateral edge of the auxiliary lever extend parallel to each other.

6. The closure buckle according to claim 1, wherein said protective plate extends along an axis that is inclined at an angle lying in the range 0° to 90° relative to a longitudinal axis of the tie rod.

7. The closure buckle according to claim 1, wherein the auxiliary lever has a pivot axis that is not perpendicular to a longitudinal axis of the tie rod.

8. The closure buckle according to claim 7, wherein a part embodying the pivot mechanism of the auxiliary lever is united with the protective plate.

9. The closure buckle according to claim 1, wherein said protective plate is connected to the main lever via a first outer edge parallel to a longitudinal axis of the tie rod and the protective plate is extended towards the end of the main lever by a second outer edge parallel to a middle axis of the auxiliary lever.

10. The closure buckle according to claim 9, wherein the second outer edge is extended by a third outer edge that, towards a front of the closure buckle, closes the housing receiving the auxiliary lever by joining up with the end edge of the auxiliary lever.

11. The closure buckle according to claim 1, wherein an upper face of the protective plate carries a bevel.

12. The closure buckle according to claim 11, wherein said bevel extends continuously over the upper face of the protective plate, and a thickness of the protective plate is thinner going towards an outer lateral edge of the plate.

13. The closure buckle according to claim 1, wherein the protective plate includes a beveled upper face that is flush with the auxiliary lever and an upper face of the main lever.

14. The closure buckle according to claim 1, wherein a lower face of the auxiliary lever and a lower face of an end of said protective plate are beveled and extend in the same plane that is raised relative to the plane of the base.

15. A downhill ski boot equipped with at least one closure buckle according to claim 1.

16. The downhill ski boot according to claim 15, wherein the protective plate is positioned towards a front of the boot while the auxiliary lever is positioned towards a rear of the boot.

17. A closure buckle for closing a ski boot, comprising:

a main lever hinged to a base, the main lever having a longitudinal notch in which a tie rod is mounted, the tie rod being connected to a fastener hook and the main lever having an end carrying an auxiliary lever, the auxiliary lever provided with a pivot mechanism and a lateral edge, wherein the main lever comprising a lever body and a protective plate, the protective plate having an outer edge extending beyond the end edge of the main lever and protecting the auxiliary lever and the pivot mechanism of the auxiliary lever, said plate having an inner edge that is facing the lateral edge of the auxiliary lever.

18. A closure buckle for closing a ski boot, comprising:

a main lever hinged to a base, the main lever having a longitudinal notch in which a tie rod is mounted, the tie rod being connected to a fastener hook and the main lever having an end carrying an auxiliary lever, the auxiliary lever provided with a pivot mechanism and lateral sides, wherein the main lever comprises a lever body and a protective plate, the protective plate having an outer edge that extends beyond the lever body and projecting therefrom while being positioned on only one of the lateral sides of the auxiliary lever.

* * * * *